US007581353B1

(12) United States Patent
Gill et al.

(10) Patent No.: US 7,581,353 B1
(45) Date of Patent: Sep. 1, 2009

(54) MODULAR PANEL GATE ASSEMBLY FOR A CANTILEVER SLIDE GATE SYSTEM

(75) Inventors: Bruce G. Gill, Greenwich, NY (US); Douglas J. Blanchard, Greenwich, NY (US)

(73) Assignee: Tymetal Corp., Greenwich, NY (US)

( * ) Notice: Subject to any disclaimer, the term of this patent is extended or adjusted under 35 U.S.C. 154(b) by 0 days.

(21) Appl. No.: 12/040,794

(22) Filed: Feb. 29, 2008

(51) Int. Cl.
*E05D 15/06* (2006.01)

(52) U.S. Cl. ..... 49/404; 49/425; 49/409; 49/410; 49/501; 256/73

(58) Field of Classification Search ..... 49/404, 49/425, 409, 410, 501; 256/73
See application file for complete search history.

(56) References Cited

U.S. PATENT DOCUMENTS 1,750,897 A * 3/1930 Lofy ..... 49/409
3,705,468 A * 12/1972 Ashworth ..... 49/409
3,973,616 A * 8/1976 Jensen ..... 160/199
3,985,461 A * 10/1976 Gebhard ..... 403/292
4,031,664 A * 6/1977 Wendt ..... 49/409
4,123,874 A * 11/1978 Scott ..... 49/411
4,193,500 A * 3/1980 Scott ..... 206/577
4,369,953 A * 1/1983 Greiner et al. ..... 256/24
4,416,086 A * 11/1983 Niekrasz ..... 49/388
4,623,128 A * 11/1986 Dutch et al. ..... 256/65.08
4,723,374 A * 2/1988 Peterson et al. ..... 49/404
5,136,813 A * 8/1992 Gibbs et al. ..... 49/404
5,189,758 A * 3/1993 Levy ..... 16/87.4 R
5,261,189 A * 11/1993 Chu ..... 49/404
5,272,838 A * 12/1993 Gibbs ..... 49/404
5,291,687 A * 3/1994 Abad ..... 49/404
5,560,149 A * 10/1996 Lafevre ..... 49/501
5,870,859 A * 2/1999 Kitada ..... 49/404
6,751,907 B1 * 6/2004 De Gasperis ..... 49/404
6,874,767 B1 * 4/2005 Gibbs ..... 256/65.08
6,969,051 B1 * 11/2005 Gibbs ..... 256/65.01
7,322,564 B2 * 1/2008 Fakhari ..... 256/65.01
7,430,832 B2 * 10/2008 Hung ..... 49/404

* cited by examiner

*Primary Examiner*—Katherine W Mitchell
*Assistant Examiner*—Jeff Tang
(74) *Attorney, Agent, or Firm*—Cermak Kenealy Vaidya & Nakajima LLP

(57) ABSTRACT

A modular slide gate is movable along a hanger assembly of a cantilever slide gate system between an open position where access through a secured perimeter is permitted and a closed position where access through a secured perimeter is obstructed. The modular slide gate can include a top member, a bottom member, and a plurality of cross-members extending between and connected to the bottom member and the at least one wall of the frame member. The top member can include a frame member and a track member. The frame member can include at least one wall. The track member can be configured and dimensioned to receive the hanger assembly and can include at least one wall that extends continuously from and is homogenous with the at least one wall of the frame member.

20 Claims, 3 Drawing Sheets

MODULAR PANEL GATE ASSEMBLY FOR A CANTILEVER SLIDE GATE SYSTEM

BACKGROUND

1. Field

The presently disclosed subject matter relates to devices, systems, and processes useful as sliding gates, and more specifically to a modular panel gate assembly that can provide customizable gate lengths from mass-production components.

2. Description of the Related Art

There are many security gate configurations currently in use to permit vehicular and/or pedestrian access to a commercial/industrial or other site secured by a perimeter or other fence. One configuration is a cantilever slide gate in which one section of the gate is supported above the ground between two support post assemblies and another portion of the gate extends across the opening in the security fence when the gate is in the closed position. U.S. Pat. No. 4,723,374 to Peterson discloses a typical slide gate system, and is incorporated herein by reference.

FIG. 1 illustrates a cantilever slide gate system 200. The cantilever slide gate system 200 includes a gate 202 vertically suspended above the ground by a plurality of support post assemblies 204 (only one is shown). The support post assemblies 204 support the weight of the gate 202 and cooperate with the gate 202 to guide the gate 202 between the closed position and the opened position.

The gate 202 includes a top primary member 206, a track member 208, a lower tube member 210, and a plurality of vertical members 212 (only one is illustrated). The top primary member 206, the lower tube member 210, and the track member 208 are shown in cross-section in FIG. 1. The vertical members 212 extend between and are connected to the top primary member 206 and the lower tube member 210, for example, by stitch welding. The track member 208 is also secured to the top primary member 206 by stitch welds.

In order to properly align the track member 208 with the top primary member 206, the top primary member 206 includes a keyway 214 and the track member 208 includes a key 216. The track member 208 also includes a horizontal flange 218 that extends across a top external surface 220 of the top primary member 206 and a vertical flange 220 that extends along a side surface (not numbered) of the top primary member 206. The track member 208 includes an inner surface (not numbered) that defines a track that is configured to receive a truck 224 of a hanger assembly 226 from which the gate 202 is suspended. The vertical flange 222 extends from the track member 298 below the track (not numbered). The key 216 is positioned at a location intermediate the track (not numbered) and the vertical flange 222.

Each support post assembly 204 includes a support post 228, a lower guide assembly 230, and the above-described hanger assembly 226. The hanger assembly 226 includes the truck 224 and a hanger bracket 232 secured to the truck 224. The hanger bracket 232 is secured to the support post 228 by a plurality of U-bolts 234. The lower guide assembly 230 is secured to the support post 228 by a U-bolt 236.

The truck 224 includes a pair of horizontal rollers 238 (only one is visible in FIG. 1) and four vertical rollers 240 (only two are visible in FIG. 1). The horizontal rollers 238 engage the inner side walls (not numbered) of the track (not numbered) and the vertical rollers 240 engage the upper and lower surfaces (not numbered) of the track (not numbered). Thus, the hanger assembly 224 and the track member 208 cooperate to support the gate 202 above the ground as the gate 202 moves between the closed position and the open position.

The lower guide assembly 230 engages the sides (not numbered) of lower tube member 210 to limit horizontal displacement of the gate 202 toward and away from the support post 228 as the gate 202 moves between the closed position and the opened position.

Existing cantilever sliding gate systems are typically custom built to meet dimensional requirements specific to each customer. That is, the top primary member 206 and the lower tube member 210 are each made from a single extruded blank that has a length equal to the length required by the end user for the gate 202. In some cases, for a very long section, the track and top primary member can be spliced at alternating locations. Specifically, the track and the top primary member can be located relative to each other so that each track member overlaps two top primary members, and vice versa, and are then joined by welds or other attachment structures. This type of overlap splice provides greater strength when the gate is assembled.

However, custom built sliding gate systems can be labor intensive, can take a long period of time from order to delivery, and can be costly to manufacture and ship to the end user.

Modular systems can reap the benefits of mass production volumes while also permitting designed-in versatility for customization for each end user. The gate modules can be sized to meet standard shipping requirements. Thus, modular sliding gate systems can provide economies of scale from mass-production and significantly reduce shipping and installation cost per gate. In addition, certain strength and operation benefits can be achieved by a modular system.

However, many of the existing and prior modular sliding gate systems might not meet certain ASTM and other industry guidelines. In addition, many of these prior attempts at modular sliding gate systems might not meet customer demands for long-term performance, durability, ease of assembly, etc.

SUMMARY

According to one aspect of the disclosure a modular slide gate is movable along a hanger assembly of a cantilever slide gate system between an open position where access through a secured perimeter is permitted and a closed position where access through a secured perimeter is obstructed. The modular slide gate can include a top member, a bottom member, and a plurality of cross members extending between and connected to the bottom member and the at least one wall of the frame member. The top member can include a frame member and a track member. The frame member can include at least one wall. The track member can be configured and dimensioned to receive the hanger assembly and can include at least one wall that extends continuously from and is homogenous with the at least one wall of the frame member.

According to an aspect of the disclosed subject matter, a modular panel gate assembly for a cantilever slide panel gate system can include a support assembly and a hanger assembly secured to the support assembly. The support assembly can suspend the modular gate panel assembly in a cantilevered manner as the modular panel gate assembly moves along the hanger assembly between a closed position where the modular gate panel assembly can obstruct access through an opening in a secured perimeter and an opened position where the modular panel gate assembly can permit access through the opening in the secured perimeter. The modular panel gate assembly can include a first gate panel and a second gate panel. The first gate panel can be disengageable from support assembly and the hanger assembly when the modular panel gate assembly is in the closed position and engageable with the support assembly and the hanger assembly when the modular gate panel assembly is in the opened position. The first gate panel can include a first top member, a first bottom member, and a plurality of cross members. The top member can include a first frame member and a first track member. The first track member can be secured to and extend from the first frame member. The first track member can be configured and dimensioned to receive the hanger assembly. The first bottom member can extend parallel to the first top member. The first plurality of cross members can extend between and connect to the first bottom member and the first frame member. The second gate panel can be engageable with the support assembly and the hanger assembly when the modular panel gate assembly is in the closed position and disengageable with the support assembly and the hanger assembly when the modular gate panel assembly is in the opened position. The second gate panel can include a second top member, a second bottom that can extend parallel to the top member, a second plurality of cross members that can extend between and connect to the second bottom member and the second frame member. The second top member can include a second frame member and a second track member. The second track member can be secured to and extend from the second frame member. The second track member can be configured and dimensioned to receive the hanger assembly. A first connector can be secured to the first and second frame member, a second connector can be secured to the first and second bottom members, and a third connector can be secured to the first and second track members.

BRIEF DESCRIPTION OF THE DRAWINGS

The disclosed subject matter of the present application will now be described in more detail with reference to exemplary embodiments of the apparatus and method, given by way of example, and with reference to the accompanying drawings, in which.

DETAILED DESCRIPTION OF EXEMPLARY EMBODIMENTS

Figure 1:
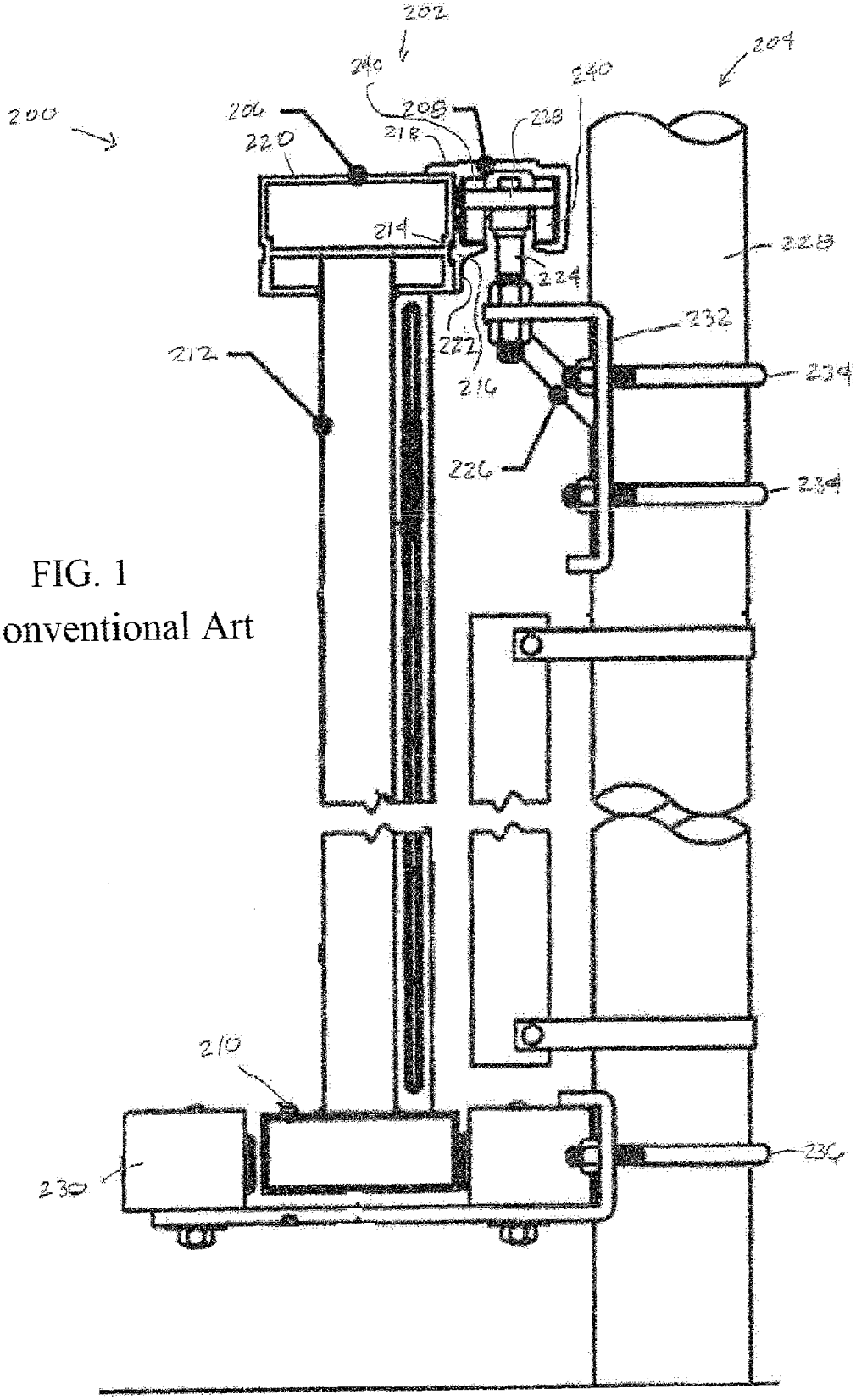
FIG. 1 Conventional Art
FIG. 1 illustrates a commercially available cantilever sliding gate that is of a customized one-piece design.
Figure 2:
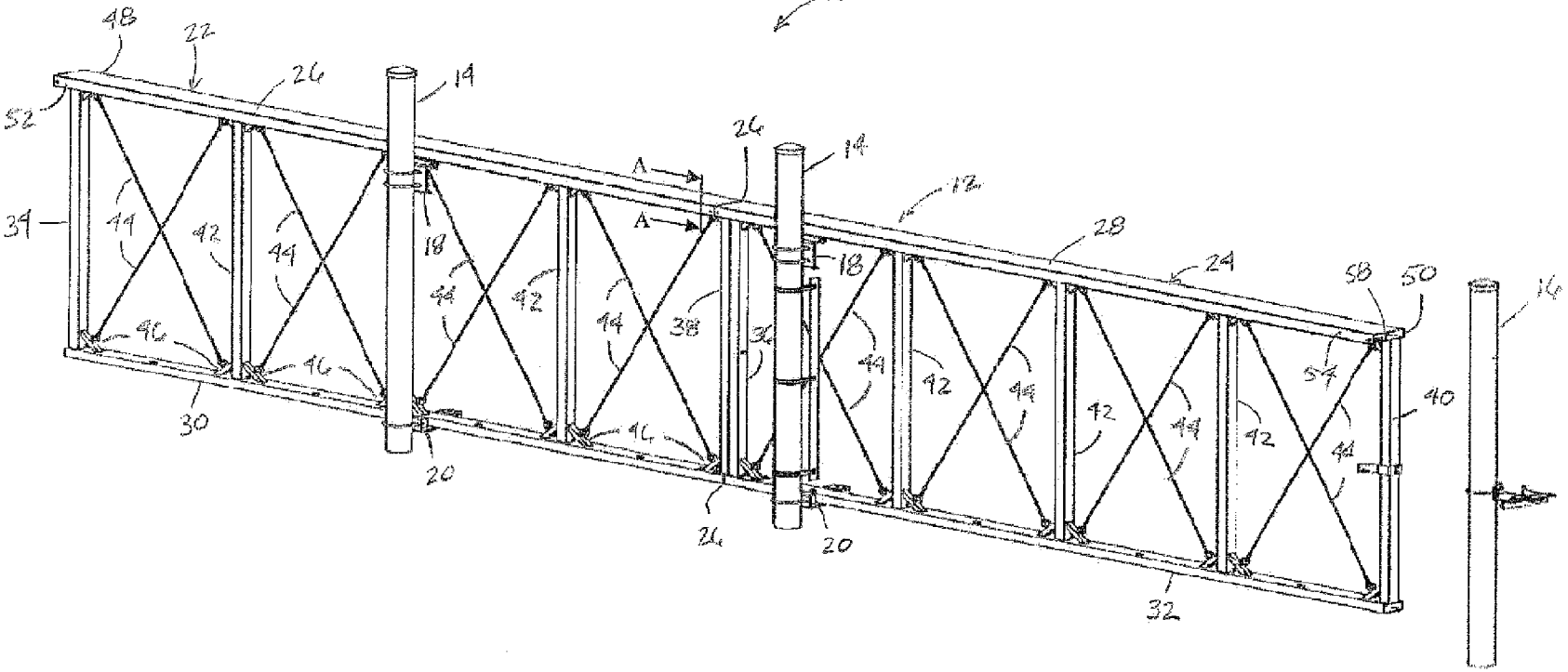
FIG. 2 is a perspective view of an embodiment of a modular cantilever sliding gate system in accordance with the disclosed subject matter.

FIG. 2 illustrates a modular cantilever slide panel gate system 10. The system 10 can include a modular panel gate assembly 12, two support post assemblies 14, and a catcher assembly 16. Each support post assembly 14 can include a hanger assembly 18 and a lower guide assembly 20 (see FIG. 1 for details) which support the modular panel gate assembly 12 in a cantilevered configuration and guide the modular gate panel assembly 12 as the modular panel gate assembly 12 moves between the closed position and the opened position.

The modular panel gate assembly 12 can include a first panel 22 and a second panel 24. The panels 22, 24 can be secured to one another along a joint 26. (Details of the joining of the panels 22, 24 will be discussed below.) Each panel 22, 24 can have the same length dimensions, as shown in FIG. 2, or one panel can have a length different from the other panel. For example, the first panel 22 can have a length of 18 feet and the second panel 24 can have a length of 12 feet. Alternatively, two 18 foot panels, two 12 foot panels, or a single panel of either 12 feet or 18 feet may be used. This dimensional flexibility can permit customization of the modular panel gate assembly 12 to fit gate openings ranging from 8 to 25 feet by the manufacture and assembly of only two different panel sizes as compared to a customized gate panel which must be manufactured individually for each gate opening size specified by the end user. Of course, other "standard" size and "standard" dimensions can be used for each of the modular gate panels 22, 24 without departing from the spirit and scope of the disclosed subject matter. In addition, three or more panels could be used for certain applications of the disclosed subject matter. The disclosed gate can facilitate quick and easy replacement of each of the modular gate panels. For example, if one gate panel is destroyed or broken, a modular replacement can be put in place right away. This achieved by either the user ordering additional modular panels and having them on site, or ensuring that a distributor in the area stock the modular gate panels. Thus, a custom repair is not necessary, and the time of any security breach caused by a defective gate can be minimized.

Figure 4:
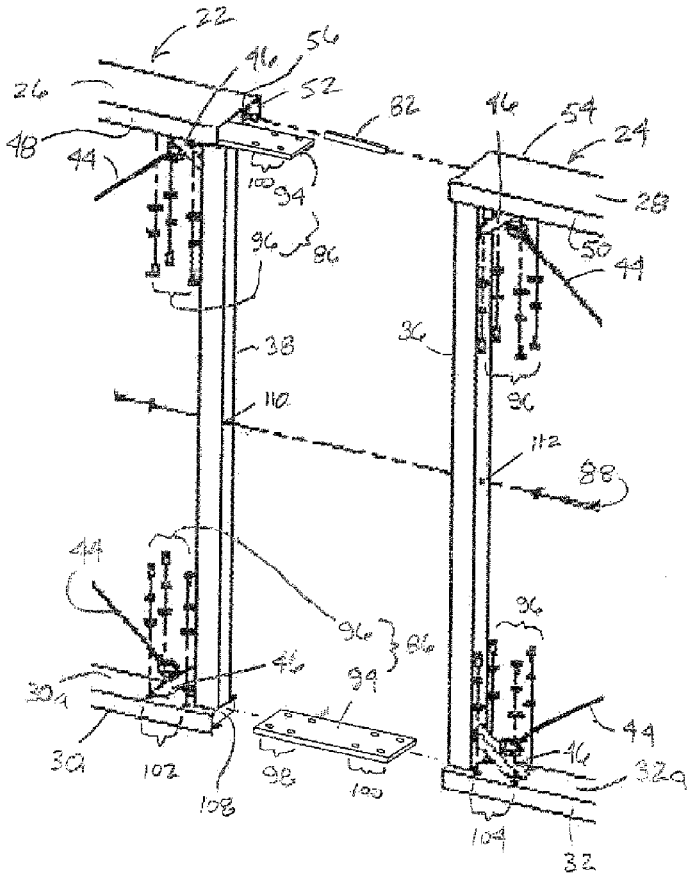
FIG. 4 is an exploded perspective view of the abutting portions of two gate panels of the modular cantilever sliding gate system of FIG. 2.

As shown in FIGS. 2 and 4, each panel 22, 24 can be structurally identical. It should be understood that although only two panels 22, 24 are shown, the use of three or more panels would also be consistent with and is contemplated as being part of the disclosed subject matter. In addition, the panels need not be identical, but can vary in shape and size dramatically. Each of the panels 22, 24 can include a top member 26, 28, a bottom member 30, 32, first exterior cross members 34, 36, second exterior cross members 38, 40 (only the second exterior cross member 38 of the first panel 22 and the first cross member 36 of the second panel 24 are shown in FIG. 4), a plurality of interior vertical members 42 (FIG. 2 only), a plurality of tensions cables 44, and a plurality of corner members 46. Each top member 26, 28 can include a frame member 48, 50 and a track member 52, 54 that both extend the entire length of the respective top member 26, 28. The top members 26, 28 can be formed by an extrusion process such that the track member 52, 54 is integrally formed as one piece with the frame member 48, 50.

Due to the integral formation of the track member 52 with the frame member 48, a common side wall 56, 58 (the common side wall 56 of the first panel is viewable in FIGS. 3 and 4 and the common side wall 58 of the second panel 24 is viewable in FIG. 2) can form a portion of each of the frame members 48, 50 and the track members 52, 54. The common side walls 56, 58 can provide a continuous load path for the forces exerted on the track members 52, 54 by the hanger assemblies 18 to the respective frame members 48, 50. This continuous load path can be a more efficient load distribution path than that provided by the two-piece track and top primary member assembly of FIG. 1. For example, the junction of the top primary member and the track member of FIG. 1 can be discontinuous due to dimensional tolerances and variations in material flow when these components are formed that can permit gaps between the abutting surfaces of the top primary member and the track member where they are not joined by the stitch weld seam. Further, raw material savings can be achieved with the one-piece top member of FIGS. 2-4 as compared to the two-piece configuration of FIG. 1 because the flanges of the separate track member are not necessary, due to this improved load path of the one-piece top member 26.

The continuous, one-piece extruded top member 26 can provide a further cost and time advantage as compared to the two-piece configuration illustrated in FIG. 1. In the two-piece design of FIG. 1, the top primary member and the track member can be formed in separate extrusion processes. Further, the top primary member and the track member are then joined together in a separate manufacturing process, such as, by a plurality of weld seams that can extend the entire length of these components. Typically, the top primary member and the track member of FIG. 1 can be formed from aluminum and can require specialized welding skills to join these two components. Thus, assembly time and manufacturing and/or labor costs can be reduced by forming the frame member and the track member in a single manufacturing step as an integral, one-piece extrusion, as compared to the two-piece design of FIG. 1.

Figure 3:
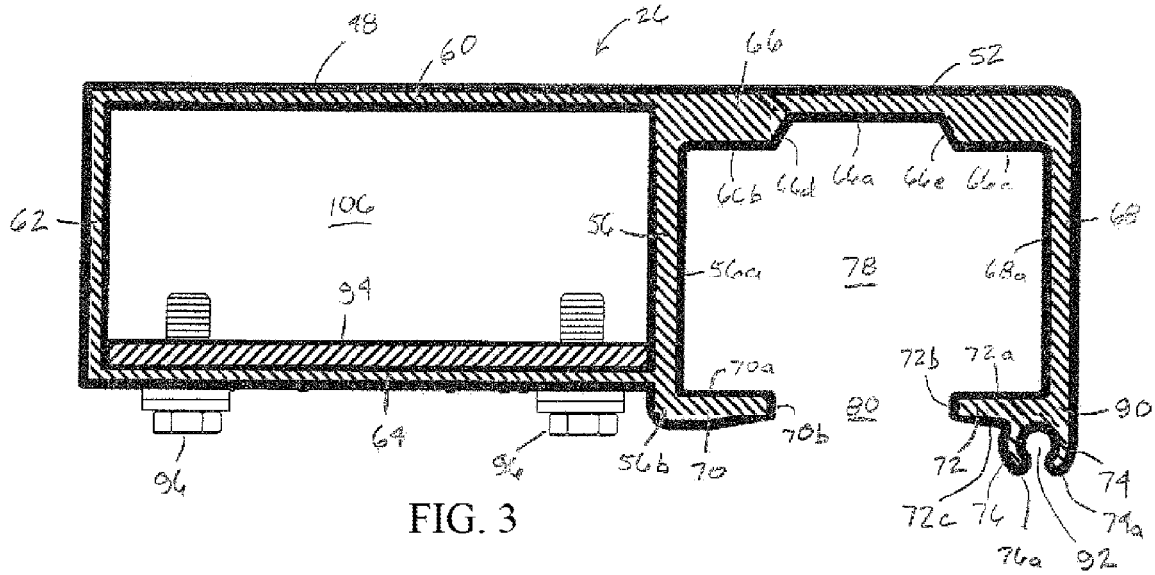
FIG. 3 is a cross-sectional view taken along A-A of FIG. 2.

The cross member 38 can have a longitudinal axis that extends vertically through the center of the cross member 38. As shown in the embodiment of FIGS. 3 and 4, the longitudinal axis will intersect with the wall 64 of the top member 26. However, the longitudinal axis will be completely spaced from the track member, and particularly from that portion of the track member that will be in contact with the rollers of the trolley.

The details of the top members 26, 28 will now be discussed with reference to FIG. 3. The top members 26, 28 of the first and second panels 22, 24 can be identical in cross-section. As such, only the cross-section of the first panel top member 26 will be discussed. The first panel frame member 48 can be a hollow tube that has a rectangular cross-section defined by the common side wall 56, a top wall 60, a side wall 62, and a bottom wall 64. The common side wall 56, the top wall 60, the side wall 62, and the bottom wall 64 are all extend continuously from and are homogenous with each other.

The track member 52 can include the common side wall 56, an upper wall 66, a side wall 68, two horizontal flanges 70, 72, an arcuate flange 74, and an intermediate arcuate flange 76 that all extend the length of the top member 26 and can be formed as a continuous, homogenous component during the extrusion of the top member 26. (The details and function of the arcuate flanges 74, 76 will be discussed below.)

The upper wall 66, the side wall 68, the common side wall 56, and the two horizontal flanges 70, 72 can include inner surfaces 56*a*, 66*a*, 66*b*, 66*c*, 66*d*, 66*e*, 68*a*, 70*a*, 72*a* that define a guide passage 78. The guide passage 78 can receive the hanger assemblies 18 and provides a guide track along which the trucks (not shown—see FIG. 1, for example) of the hanger assemblies can pass as the modular panel gate assembly 12 moves between the opened position and the closed position. Specifically, the vertical rollers (not shown —see FIG. 1, for example) can engage and roll along the inner surfaces 70*a*, 72*a* of the two horizontal flanges and the two rail surfaces 66*b*, 66*c* formed on the inner surface 66*a-e* of the upper wall 66. The horizontal rollers (not shown—see FIG. 1, for example) can engage and roll along the respective inner surfaces 56*a*, 68*a* of the common side wall 56 and the side wall 68.

Also illustrated in FIG. 3, a space can be provided between the ends 70*b*, 72*b* of the two horizontal flanges 70, 72 to define an opening 80 to the guide passage 78. The opening 80 can provide access to the guide passage 78 for a portion of the truck of the hanger assemblies 18 as the modular panel gate assembly 12 moves between the closed position and the opened position.

The inner surface 66*a-e* of the track member upper wall 66 can include a recess 66*a* intermediate the two rail surfaces 66*b*, 66*c*. The recess 66*a* can provide clearance for a portion of the truck to pass through the guide passage 78 as the modular panel gate assembly 12 moves between the closed position and the opened position.

With continued reference to FIG. 3, the bottom wall 64 of the frame member 48 can join the common side wall 56 at a position inward of the lower end 56*b* of the common side wall 56. The inboard horizontal flange 70 can extend from the lower end 56*b* of the common side wall 56. Thus, the bottom wall 64 of the top member 48 can be positioned intermediate the levels of the top wall 48 and the inboard horizontal flange 70.

As illustrated by way of example in FIGS. 3 and 4, the first and second panels 22, 24 can be joined to each other by a splice pin 82, a pair of splice assemblies 84, 86, and a central fastener 88. The splice pin 82 can cooperate with the arcuate flanges (see for example, 74, 76) of the first and second panel track members 52, 54 to maintain proper alignment of the track members 52, 54 as the modular panel gate assembly 12 passes along the hanger assemblies 18. The splice assemblies 86 can provide a rigid connection between the first and second panels 22, 24 without damaging the top and bottom members 26, 28, 20, 32 when the modular panel gate assembly 12 is static and when the modular panel gate assembly 12 moves between the closed position and the opened position. The splice assemblies 86 can also provide and maintain proper alignment of the first and second panels 22, 24 when the modular panel gate assembly is static and when it moves between the closed position and the opened position. Moreover, the splice assemblies 86 can include a splice plate 94 that can bend to some degree within a first plane containing the panels 22, 24. The bending of the splice plate 94 allows a certain degree of relative vertical movement between the panels 22, 24. The splice plate 94 can be relatively stiff in planes normal to the first plane such that little or no bending of the splice plate 94 occurs in these directions. The central fastener 88 can pass through the exterior cross members 36, 38 to maintain contact between these two abutting cross members 36, 38.

As stated above, the track member 52 can include an arcuate flange 74 and an intermediate flange 76. These arcuate flanges 74, 76 can cooperate with the splice pin 82 to provide and maintain alignment of the first panel track member 52 with the second panel track member 54 as the hanger assemblies 18 transition between the track members 52, 54 of the first and second panels 22, 24.

The arcuate flange 74 can extend continuously from and homogenously with the junction 90 of the side wall 68 and the outboard horizontal flange 72. The intermediate arcuate flange 76 can extend from the outer surface 72*b* of the outboard horizontal flange 72 at a position intermediate the end 72*b* of the outboard horizontal flange 72 and the arcuate flange 74. The arcuate flanges 74, 76 can curve towards one another and terminate at free ends 74*a*, 76*a* that are spaced from one another. The inner surfaces of the arcuate flanges 74, 76 can cooperate with one another to define a cylindrical groove 92 that can extend along the entire length of the top member 26. As viewed in FIG. 3, the free ends 74*a*, 76*a* can be spaced apart by a distance less than the diameter of the cylindrical groove 92 to prevent the splice pin 82 from falling out of the cylindrical groove 92.

Other configurations of the splice pin 82 and the groove 92 can be used, such as a pin and a groove having complimentary polygonal cross-sectional shapes. In addition, a typical roller pin can be used. The pin 82 can be hollow or solid, and can be non-symmetrical in cross-section and configured to mate with a non-symmetrical groove.

The cylindrical groove 92 and the splice pin 82 can be dimensioned and configured such that the splice pin 82 can be received in the cylindrical groove 92 by an interference fit. The splice pin 82 can be configured and dimensioned to provide a rigid joint between the track members 52, 54 of the first and second panels 22, 24 by cooperating with the arcuate flanges 74, 76 to at least minimize deflection of the outboard horizontal flange 72 of the first panel 22 relative to the outboard horizontal flange (not numbered) of the second panel 24 as the truck passes from the first panel track member 52 to the second panel track member 54. Thus, the modular panel gate assembly 12 can experience an unimpeded and relatively smooth transition as the panel joint 26 traverses each hanger assembly 18.

The splice assemblies 86 and the central fastener 88 can secure the second panel 24 to the first panel 22 such that the second panel 24 can rigidly extend from the first panel 22 in a cantilevered manner when the second panel 24 is positioned beyond the support post assemblies 14 in a static configuration (for example, when the modular panel gate assembly 12 closes more than half of the gate opening). The splice assemblies 86 and the central fastener 88 can also provide a rigid cantilevered connection between the first and second panels 22, 24 when the second panel 24 does not engage either of the support post assembles 14 while the modular panel gate assembly 12 moves between the closed position and the opened position.

Each splice assembly 86 can include a rectangular splice plate 94 and a plurality of fasteners 96. Each splice plate 94 can include a first plurality of through holes 98 and a second plurality of through holes 100. The first plurality of through holes 98 can be configured and dimensioned to align with a plurality of through holes (not illustrated) that can be provided in the first panel 22. The second plurality of through holes 100 can be configured and dimensioned to align with a plurality of through holes that can be provided in the second panel 24.

As illustrated in FIG. 4, through holes 102 can be provided in the top surface 30*a* of the first panel bottom member 30 at a position adjacent to and inboard of the second exterior cross member 38. Similarly, through holes (not visible) can be provided in the bottom surface (not visible) of the first panel frame member 48 at a position adjacent to and inboard of the second exterior cross member 38. The pattern and location of the through holes in the first panel frame member 48 can be identical to the pattern and location of the through holes 104 in the first panel bottom member 30.

As with the first panel 22, through holes 104 can be provided in the top surface 32*a* of the second panel bottom member 32 at a position adjacent to and inboard of the first exterior cross member 36. Similarly, through holes (not visible) can be provided in the bottom surface (not visible) of the second panel frame member 50 at a position adjacent to and inboard of the first exterior cross member 36. The pattern and location of the through holes in the second panel frame member 50 can be identical to the pattern and location of the through holes 104 in the second panel bottom member 32.

The number of through holes in each of the frame members 48, 50 and the bottom members 30, 32 can total four and the number of through holes 98, 100 in each splice plates 94 can total eight. However, any number of through holes and fastener assemblies 96 can be used in order to rigidly secure the first panel 22 to the second panel 24 in a cantilevered configuration.

The fastener assemblies 96 can include a threaded fastener (such as a bolt), a lock washer, and a flat washer. The threaded fasteners 96 can be inserted into respective through holes of the panels 22, 24 and the splice plates 94 to secure the splice plates 94 to the first and second panels 22, 24.

As shown in FIGS. 3 and 4, an upper splice plate 94 can be inserted into the hollow passage 106 of the first panel frame member 48 and secured to the inner surface of the bottom wall 64. After aligning the first plurality of through holes 98 of the upper splice plate 94 with their corresponding plurality of through holes (not shown—see, for example, the through holes 102 of the bottom member 30 shown in FIG. 4) in the bottom wall 64, the threaded fasteners can be inserted through the aligned through holes and partially tightened so that alignment of the panels 22, 24 can occur.

Similarly, the lower splice plate 94 can be inserted into the hollow passage 108 of the first member bottom member 30 and secured to the inner surface of the top wall (not numbered) and loosely secured with a plurality of fastener assemblies 96.

After the splice pin 82 and the splice plates 94 have been loosely secured to the first panel 22, the second panel 24 can be joined to the first panel 22. First, the second panel 24 can be aligned with the splice pin 82 and the splice plates 94. Next, the second panel 24 can be displaced toward the first panel 22 so that the splice pin 82 enters the cylindrical groove (not visible) in the second panel track member 54 and the splice plates 94 enter the hollow passages (not visible) of the second panel top and bottom members 28, 32. Next, the first and second panels 22, 24 can be adjusted in alignment so that the through holes 100 of the upper splice plate 94 align with the trough holes (not visible) in the second panel frame member 50 while a straight edge spans the panel joint 26. Next, the threaded fasteners of the fastener assemblies 96 can be inserted into the through holes and all of the threaded fasteners can be fully tightened to secure the first and second panels 22, 24 to the upper splice plate 94. These last two steps can be repeated for the lower splice plate 94 and the second panel bottom member 32. Finally, the central fastener 88 can be inserted into a central through bore 110, 112 in each of the exterior cross members 36, 38 and tightened. The central fastener 88 can include a threaded fastener (such as a bolt), a washer and a threaded nut.

The customer can complete the final assembly on-site without the need for highly skilled labor. Thus, reducing overall costs and assembly time.

The panels can be joined by other structure/methods, such as clamps, rivets, differently shaped splice plates, splice tubes, bolts, etc.

After, the first and second panels have been secured together, the modular gate can be hung on the hanger assembly and the alignment of the first and second panels can be fine tuned by tightening respective cables to eliminate any sagging that may occur in the panels.

With reference to FIG. 1, the catcher assembly 16 can include a post 114, a catcher, 116, and a companion 118. The companion 118 can be configured and dimensioned to mate with the catcher 116 when the modular panel gate assembly 12 is in the closed position. The companion 118 can be secured to the second external cross member 40 of the second panel 24. Alternatively, catcher assembly 16 can be positioned on the other side of the modular panel gate assembly 12, as viewed in FIG. 1, such that the companion 118 can be secured to the first external cross member 34 of the first panel 22 and the post 114 with the catcher 116 can be positioned so that the first external cross member 34 is spaced from the post 114 when the modular gate panel assembly 12 is in the opened position and the first cross external member is adjacent the post 114 when the modular gate panel assembly 12 is in the closed position. Thus, the catcher assembly 16 can be used with a left-hand opening modular gate panel assembly and a right-hand opening modular gate panel assembly 12.

While certain embodiments of the invention are described above, it should be understood that the invention can be embodied and configured in many different ways without departing from the spirit and scope of the invention. For example, the top member can be produced by other known forming methods, for example, hydroforming, casting, folding sheet metal, etc. However, some forming methods may dictate or permit a completely different cross-sectional shape, and therefore it must be determined whether certain forming methods are appropriate for a particular application of the disclosed subject matter. Additionally, the top frame members (and other frame members and gate components) can be produced from other various materials such as aluminum, steel, steel alloys, aluminum alloys, plastics, resin materials, composite plastics, ceramic materials, etc. The extrusion process allows the entire top member to be formed of a single continuous and homogenous material.

With regard to the splice assembly 86, other forms of the splice assembly are contemplated and should fall within the scope of the presently disclosed subject matter. For example, the splice plates could be vertically oriented instead of horizontally oriented as shown. In addition, the plates 94 could be sized and shaped in many different ways, and mate with other and differently shaped portions of the top and bottom members 22, 24, 30, 32.

As indicated above, the frame member 48 can take on many different shapes and need not be a rectangular tube structure as shown in the drawings. For example, the frame member 48 could alternatively be formed as an open I-beam structure in either a horizontal or vertical orientation. The frame member 48 can also be configured to be non-symmetrical in cross-section, polygonal in cross-section, rounded in cross-section, tubular in cross-section, etc. Likewise, the track member 52 can be formed in many different shapes, sizes and orientations with respect to the frame member and fall within the scope of the presently disclosed subject matter. In addition, the trolley could be carried on exterior surfaces of the track member 52 as well as other and differently shaped interior surfaces of the track member 52. It is even contemplated that the track member 52 and frame member 48 be incorporated into a bottom member of the device.

While the subject matter has been described in detail with reference to exemplary embodiments thereof, it will be apparent to one skilled in the art that various changes can be made, and equivalents employed, without departing from the scope of the invention. All related art references discussed in the above Description of the Related Art section are hereby incorporated by reference in their entirety.

What is claimed is:

1. A modular slide gate that is movable along a hanger assembly of a cantilever slide gate system between an open position where access through an entryway is permitted and a closed position where access through the entryway is obstructed, the modular slide gate comprises:

a single piece unitary top member that includes: a frame member that includes at least one wall that has a bottom surface; and a track member configured and dimensioned to receive the hanger assembly, the track member includes a rail portion configured to contact the hanger assembly and made from a material that extends integrally and continuously from and homogenous with the at least one wall of the frame member; a bottom member that has a top surface; and at least one cross member extending between the bottom member and the at least one wall of the frame member, the cross member having a longitudinal axis that intersects with the at least one wall of the frame member, with the at least one cross member second end is spaced from the first end by a distance; wherein the upper wall, the second wall, the third wall, the first flange, and the second flange define a guide passage for the hanger assembly, and the first and second ends define an opening in communication with the guide passage to receive a portion of the hanger assembly.

2. The modular slide gate according to claim 1, wherein the frame member further comprises a second wall, the second wall extends continuously from and is homogenous with each of the at least one wall of the frame member and the rail portion of the track member.

3. The modular slide gate according to claim 2, wherein the track member further comprises the second wall.

4. The modular slide gate according to claim 3, wherein the frame member and track member are extruded from a single homogenous material blank.

5. The modular slide gate according to claim 1, wherein the track member further comprises an outer surface and a cylindrical groove extending along the outer surface.

6. The modular slide gate according to claim 5, wherein the first flange extends continuously from and homogenous with the outer surface and the second flange extends continuously from and homogenously with the outer surface, the first and second flanges each include an arcuate inner surface that defines a portion for the cylindrical groove.

7. The modular slide gate according to claim 6, wherein:

the frame member comprises a rectangular cross-section; and the track member comprises a rectangular cross-section and an opening along one side and adjacent to the cylindrical groove.

8. The modular slide gate according to claim 7, further comprises:

a second top member that includes:

a second frame member that includes at least one wall; and a second track member configured and dimensioned to receive the hanger assembly, the second track member includes:

at least one wall that extends continuously from and is homogenous with the at least one wall of the second frame member;

an outer surface that includes a second cylindrical groove;

a first flange extending from the outer surface; and a second flange extending from the outer surface, the first and second flanges of the second track member each include an arcuate inner surface that define a portion of the second cylindrical groove;

a second bottom member;

at least one second cross member extending between and connected to the second bottom member and the at least one wall of the second frame member;

first and second splice plates, the first splice plate is connected to the frame member and the second frame member, and the second splice plate is connected to the bottom member and the second bottom member; and a splice pin received in the cylindrical groove and the second cylindrical groove in an interference fit.

9. A modular panel gate assembly for a cantilever slide panel gate system that includes a support assembly and a hanger assembly secured to the support assembly, the support assembly suspends the modular gate in a cantilevered manner as the modular panel gate assembly moves along the hanger assembly between a closed position where the gate panel obstructs access through an opening and an opened position where the gate panel permits access through the opening, the modular panel gate assembly comprises:

a first gate panel, the first gate panel includes:
a first top member that includes:
a first frame member; and
a first track member that is secured to and extends from the first frame member, the first track member is configured and dimensioned to receive the hanger assembly;
a first bottom member extending parallel to the first top member; and
at least one cross member extending between and connected to the first bottom member and the first frame member;
a second gate panel, the second gate panel includes:
a second top member that includes:
a second frame member; and
a second track member that is secured to and extends from the second frame member, the second track member is configured and dimensioned to receive the hanger assembly;
a second bottom member extending parallel to the second top member; and
at least one cross member extending between and connected to the second bottom member and the second frame member;
a first connector secured to the first and second frame members;
a second connector secured to the first and second bottom members; and
a third connector secured to the first and second track members.

10. The modular panel gate assembly according to claim 9, wherein the first gate panel has a first length and the second gate panel has a second length that is different from the first length.

11. The modular panel gate assembly according to claim 10, wherein each of the first top member, the first frame member, and the first track member have a length equal to the first length; and
wherein each of the second top member, the second frame member, and the second track member have a length equal to the second length.

12. The modular panel gate assembly according to claim 9, wherein each of the frame member and the track member terminate at respective first and second ends, the first end of the frame member is coplanar with the first end of the track member, and the second end of the frame member is coplanar with the second end of the track member.

13. The modular panel gate assembly according to claim 12, wherein the first ends define a first end of the top member and the second ends define a second end of the top member; and
wherein the bottom member terminates at first and second ends that are coplanar with the first and second ends of the top member, respectively; and
wherein the at least one cross-member includes a surface that is coplanar with the first ends of the top and bottom members and another one of the plurality of cross-members includes a surface that is coplanar with the second ends of the top and bottom members.

14. The modular panel gate assembly according to claim 13, wherein the first connector and second connector comprise a first and second splice plates, respectively, the first splice plate includes a first end connected to the first frame member and a second end connected to the second frame member, and the second splice plate includes a first end connected to the first bottom member and a second end connected to the second bottom member.

15. The modular panel gate assembly according to claim 14, wherein the first and second frame members further comprise first and second passages, respectively, the first end of the first splice plate extends into the first passage and the second end of the first splice plate extends into the second passage; and
wherein the first and second bottom members further comprise first and second passages, respectively, and the first end of the second splice plate extends into the first passage of the first bottom member and second and of the splice plate extends into the second passage of the second bottom members.

16. The modular panel gate assembly according to claim 15, further comprises:
a first plurality of threaded fasteners that pass through the first frame and the first end of the first splice plate:
a second plurality of fasteners that pass through the second frame and the second end of the first splice plate;
a third plurality of fasteners that pass through the first bottom member and the first end of the second splice plate; and
a fourth plurality of fasteners that pass through the second bottom member and the second end of the second splice plate.

17. The modular panel gate assembly according to claim 9, wherein the first and second connectors each comprise a splice plate and a plurality of threaded fasteners, the plurality of fasteners engage the respective splice plate and a respective one of the top and bottom members.

18. The modular panel gate assembly according to claim 17, wherein:
the first and second track members comprise first and second cylindrical grooves, respectively, in the outer surfaces of the first and second track members; and
the third connector comprises a cylindrical pin received in the first and second grooves in an interference fit.

19. The modular panel gate assembly according to claim 9, further comprising:
a third gate panel, the third gate panel includes:
a third top member that includes:
a third frame member; and
a third track member that is secured to and extends from the third frame member, the third track member is configured and dimensioned to receive the hanger assembly;
a third bottom member extending parallel with the third top member; and
at least one cross member extending between and connected to the third bottom member and the third frame member.

20. A cantilever slide gate system for selectively permitting access through and obstructing an entryway comprises:
a pair of support post assemblies adjacent the entryway, each support post assembly includes a post and a hanger assembly secured to the post; and
a modular gate panel suspended from and movable along the hanger assemblies between the closed position where access through the entry is obstructed by the modular gate panel and an opened position where access through the entryway is permitted, the modular gate panel includes:
a single piece unitary top member that includes:
a frame member that includes at least one wall; and
a track member that includes a rail portion made from a material that extends integrally and continuously from and homogenous with the at least one wall of the frame member, and the rail portion selectively and movably receives the hanger assemblies as the modular gate panel moves between each of the closed position and the opened position;

a bottom member; and at least one cross member extending between the bottom member and the at least one wall of the frame member, the cross member having a longitudinal axis that intersects with the at least one wall of the frame member and is completely spaced from the rail portion of the track member.

* * * * *